US006813867B1

(12) United States Patent
Forsström et al.

(10) Patent No.: US 6,813,867 B1
(45) Date of Patent: Nov. 9, 2004

(54) METHOD OF AND APPARATUS FOR THREADING OF A WRAPPER WEB INTO A NIP BETWEEN DRAWING ROLLS IN A WRAPPING DEVICE

(75) Inventors: Risto Forsström, Lahti (FI); Eero Mielonen, Lahti (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/445,004

(22) PCT Filed: Apr. 1, 1999

(86) PCT No.: PCT/FI99/00281

§ 371 (c)(1),
(2), (4) Date: Dec. 3, 1999

(87) PCT Pub. No.: WO99/50147

PCT Pub. Date: Oct. 7, 1999

(30) Foreign Application Priority Data

Apr. 1, 1998 (FI) ..... 980751

(51) Int. Cl.[7] ..... B65B 1/02; B65B 57/02

(52) U.S. Cl. ..... 53/396; 53/505; 53/385.1; 493/10

(58) Field of Search ..... 53/396, 399, 505, 53/506, 211–385.1, 409, 430, 465, 216, 389.2; 493/10, 23, 419; 226/12, 43, 143, 97.1; 242/562, 562.1, 563

(56) References Cited

U.S. PATENT DOCUMENTS

| | | | | | |
|---|---|---|---|---|---|
| 3,712,610 | A | * | 1/1973 | Garrone | 270/79 |
| 3,795,371 | A | * | 3/1974 | Tolini et al. | 15/100 |
| 3,999,696 | A | * | 12/1976 | Reba et al. | 226/7 |
| 4,003,527 | A | | 1/1977 | Schulze | 242/58 |
| 4,243,186 | A | * | 1/1981 | Peter et al. | 226/91 |
| 4,278,489 | A | * | 7/1981 | Horsley | 156/361 |
| 4,574,566 | A | * | 3/1986 | Eaves et al. | 53/450 |
| 4,662,149 | A | * | 5/1987 | Hamilton | 53/453 |
| 4,914,891 | A | | 4/1990 | Suolahti | 53/399 |
| 4,930,711 | A | * | 6/1990 | Morizzo | 242/527 |
| 5,079,899 | A | * | 1/1992 | Kurachi | 53/399 |
| 5,092,104 | A | * | 3/1992 | Zelenka | 53/167 |
| 5,197,688 | A | * | 3/1993 | Giorgio et al. | 242/562 |
| 5,265,399 | A | * | 11/1993 | Niskanen et al. | 53/136.2 |
| 5,330,125 | A | * | 7/1994 | Dylla | 242/562 |
| 5,364,332 | A | * | 11/1994 | Gray, Jr. | 493/23 |
| 5,513,478 | A | * | 5/1996 | Abt | 53/118 |
| 5,642,600 | A | * | 7/1997 | Hooper et al. | 53/136.2 |
| 5,735,474 | A | * | 4/1998 | Narukami | 226/118.1 |
| 5,816,149 | A | * | 10/1998 | Kagawa et al. | 101/128.4 |
| 5,947,408 | A | * | 9/1999 | Miyake | 242/562 |
| 6,024,682 | A | * | 2/2000 | Mandel et al. | 493/23 |
| 6,250,624 | B1 | * | 6/2001 | Kiyohara et al. | 226/196.1 |

FOREIGN PATENT DOCUMENTS

| | | | |
|---|---|---|---|
| GB | 2 197 842 A | 6/1988 | B65B/11/04 |
| SE | 503 181 | 5/1988 | B65B/25/14 |
| SE | 503 181 C2 | 4/1996 | |

* cited by examiner

*Primary Examiner*—John Paradiso
(74) *Attorney, Agent, or Firm*—Cohen, Pontani, Lieberman & Pavane

(57) ABSTRACT

Method of and apparatus for threading of a wrapper end (31) from a wrapper roll (3) to a nip between wrapper proportioning drawing rolls (11, 15) in a wrapping station for wrapping paper rolls, board rolls and pulp rolls, in which the prepared wrapped roll (3) is rotated in a use station in the direction opposite to the wrapper feeding direction in such way that the wrapper end (31) falls on a wrapper feeding table (10). The wrapper end (31) that has fallen on the wrapper feeding table (10) is indicated and the rotating motion or the wrapper roll is stopped when the wrapper end (31) has been detected. Now the roll (3) is rotated in the wrapper feeding direction, until the wrapper end (31) passes an indicator placed after the drawings rolls.

5 Claims, 3 Drawing Sheets

METHOD OF AND APPARATUS FOR THREADING OF A WRAPPER WEB INTO A NIP BETWEEN DRAWING ROLLS IN A WRAPPING DEVICE

PRIORITY CLAIM

This is a national stage of PCT application No. PCT/FI99/00281, filed on Apr. 1, 1999. Priority is claimed on that application, and on patent application No. 980751 filed in Finland on Apr. 1, 1998.

FIELD OF THE INVENTION

The invention concerns a method as an apparatus for threading the end of a wrapper web from a wrapper roll into a nip between wrapper proportioning drawing rolls.

BACKGROUND OF THE INVENTION

Getting a modern wrapping machine and roll wrapping device ready for operation usually requires the input of at least two operators. Using older equipment, getting it ready for operation and changing the wrapper rolls can be even harder. One of the most time-consuming and care-requiring tasks is the threading of the wrapper web from a new roll brought to the wrapping device into the nip between the wrapper proportioning drawing rolls. The wrapper has to remain straight during the feeding and the nip between the drawing rolls has to be closed in such way that both edges of the wrapper are of the same length between the roll and the drawing roll nip. In this way a uniform transverse tension of the wrapper is achieved. Since the positions of the wrapper roll and the drawing roll are invariable with respect to each other, a wrapper that has been positioned askew cannot straighten out in the drawing roll nip, except by wrinkling before the drawing roll nip, and the wrinkle goes through the nip. Further, if the transverse tension of the wrapper is not uniform, the tension of the wrapper that is to be wrapped around a roll will become nonuniform and the wrapping quality will suffer, because a loose wrapper layer will not support the roll sufficiently. A uniform wrapper tension is of particular significance to the quality of the wrapping in the so-called multiple wrapping, where several parallel rounds of wrapper are wrapped around a roll.

SUMMARY OF THE INVENTION

The object of the present invention is to provide a method and apparatus for threading a wrapper automatically and reliably from the wrapper roll to the nip between the wrapper proportioning drawing rolls. A prepared roll positioned ready for use is rotated against the feeding direction, whereupon the free wrapper end arrives on the wrapper feeding table and can be detected. When the wrapper end has been detected, the direction of rotation of the wrapper roll is changed and the wrapper is advantageously fed by blowing air to the nip between the drawing rolls and the nip is closed.

Considerable advantages are achieved by means of the present invention.

The most significant advantage of the invention is that the end of the wrapper can be threaded to the drawing roll nip automatically and very reliably. The wrapper does not need to be threaded by hand at any stage and the wrapper is always guided by the machine straight forward, whereupon the wrapper arrives straight to the drawing roll nip and its transverse tension will become uniform when the drawing roll nip is closed. Due to the automatic and reliable guiding the number of possibilities for errors in connection with the changing of wrapper rolls will decrease, by which the quality and reliability of the functioning of the entire wrapping system can be influenced. This makes the work of the wrapping machine operators easier, enabling them to concentrate on the matters that are the most essential ones for the functioning of the system and on the quality control of the rolls that are to be wrapped.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
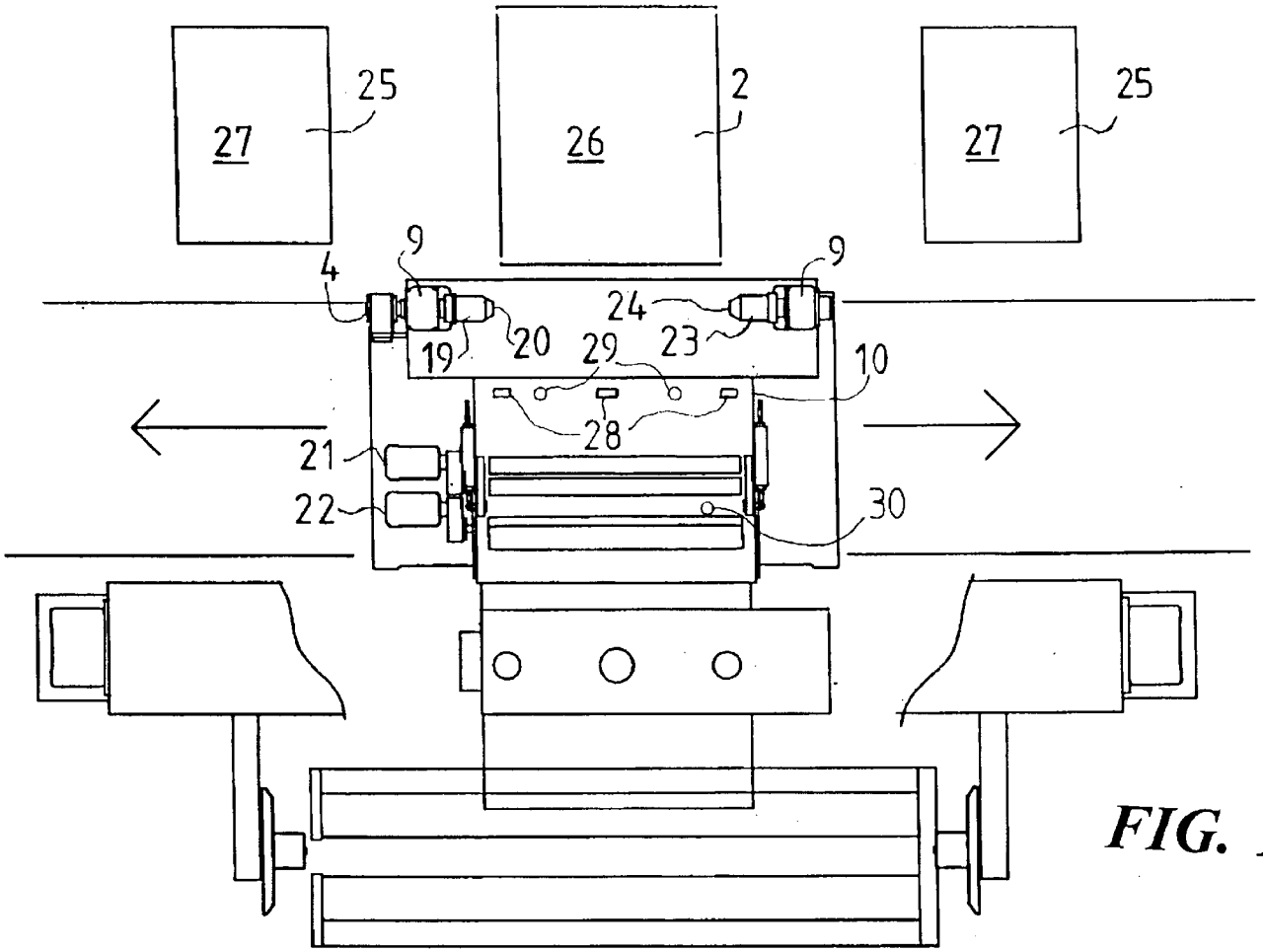
FIG. 1 is an illustration of a device in accordance with the invention seen from above.
Figure 2:
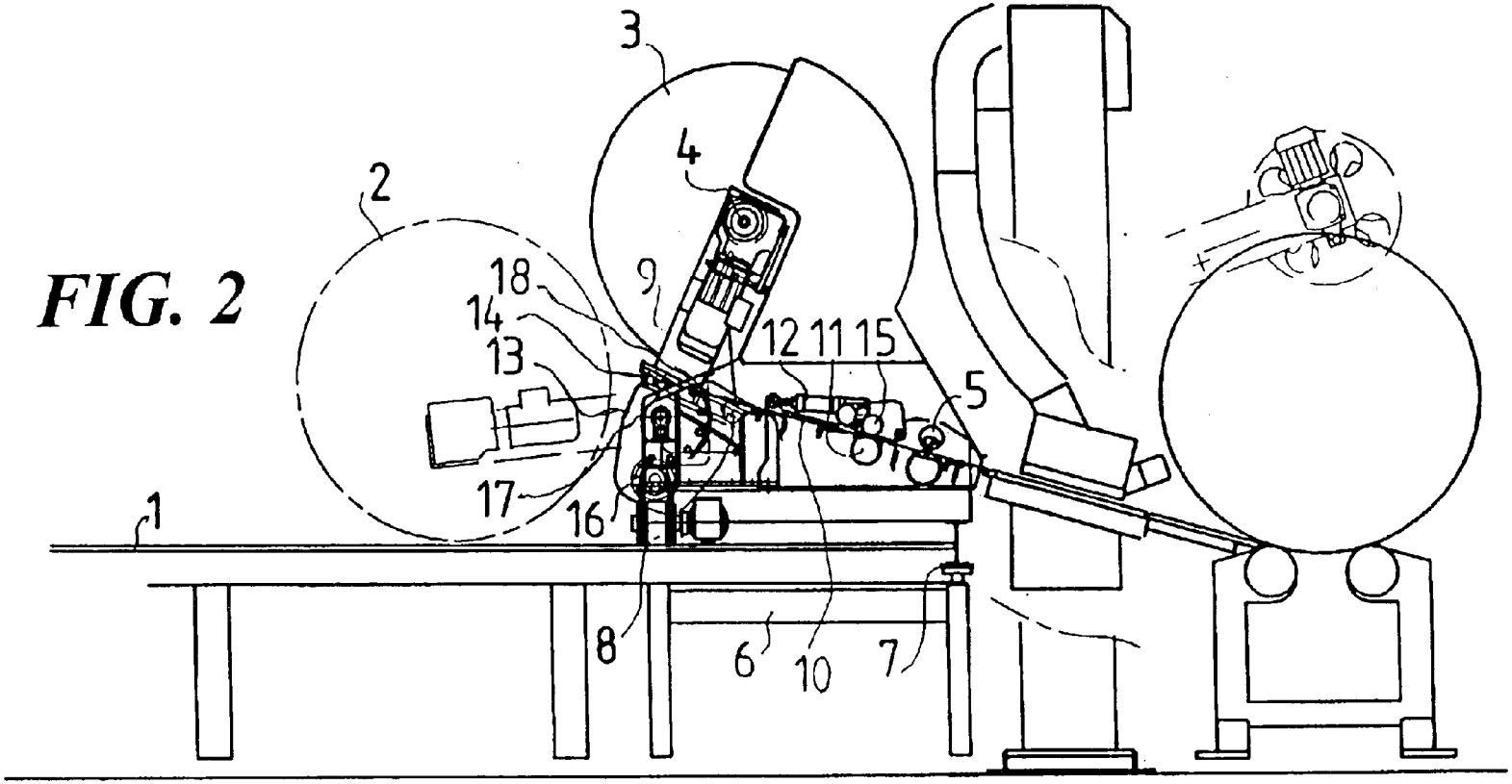
FIG. 2 is an illustration of a device in accordance with FIG. 1 seen from the side.

In FIGS. 1 and 2 there are shown devices for feeding a wrapper from a wrapper roll to wrapper handling members of a wrapping machine. These devices are positioned in connection with wrapping devices, which roll the wrapper around a roll that is to be wrapped. The wrapping device and its support rolls are shown schematically. The rolls that are to be wrapped are brought on a conveyor to a wrapping station and a roll is placed on the support rolls by changing the height between the conveyor and the support rolls, after which the roll is rotated on the support rolls and the wrapper is wrapped around the roll.

With respect to the support rolls, on the opposite side of the wrapping station there is a storage table 1 for storing wrapper rolls 2 of various sizes. In this embodiment there is one pick-up station 26 on the storage table 1 and on both sides of it delivery stations 27. At each station is shown a roll 2, 25. The wrapping station is set up on a frame structure 6 and wrapper proportioners, i.e. a wrapper carriage and a roll in use 3, have been positioned on their one side on rails 7 which are parallel to the roll that is to be wrapped and on their other side on an electric motor-driven drive gear 8. The position of the wrapper feeding devices is controlled by an absolute sensor, which is placed on the drive gear shaft. This wrapper roll handling device is intended for the kind of wrapping station applications in which the roll that is to be wrapped can be wrapped in several parallel rounds of wrapper using a wrapper that is narrower than the roll that is to be wrapped. In this kind of device it has to be possible to move the wrapper feeding device in line with the longitudinal axis of the roll that is to be wrapped, in the way that is shown with arrows in FIG. 1.

The wrapper proportioners comprise swinging arms 9 for supporting the wrapper material roll 3, below the roll 3 the first part 10 of a wrapper feeding table, in connection with which there are placed conventional drawing rolls 11, 15 for feeding the wrapper and a cross cutting device 5 for cutting the wrapper. The first part 10 of the wrapper feeding table inclines down and at its bottom end after the cross cutting device 5 there is the second part of the feeding table, which continues to the support roll that is on the side of the wrapping station. In the first part 10 of the wrapper feeding table there are air nozzles 28 for forming a stream of air along the surface of the table 10 downwards and sensors 29 for detecting the wrapper end. After the drawing rolls 11, 15 there is also a sensor 30 for indicating the wrapper end.

The wrapper is fed from the first part 10 of the wrapper feeding table along the second part to the roll that is to be wrapped. The drawing rolls 11, 15 have been placed in such way that the upper edge of the roll 11, which is under the first part 10 of the wrapper feeding table, is approximately on the same level as the table 10 and the roll 15, which is above the table, has been placed to press against the roll 11 below, guided by a cylinder 12. With the cylinder 12 a sufficient pressure is achieved between the rolls 11, 15 for drawing the wrapper and by means of it the nip between the rolls 11, 15 can be opened while the wrapper end is being threaded. The drawing rolls 11, 15 are driven by a motor 21 and the cross cutting device is driven by a motor 22.

The swinging arms 9 have been arranged to swing supported by end plates 13 towards the storage table 1 round a shaft 17. A toothed segment 18 and an electric gear motor 16 equipped with a toothed wheel, which function in connection with each other, have also been attached to the end plate 13. At the opposite end, with respect to the end plate of thie other swinging arm 9, there is an electric gear motor 4 for rotating the wrapper roll 3. On the shaft of the gear motor 4 there is a spindle 19, the end of which is conical-shaped. At the end of the opposite arm there is a freely rotating similarly shaped spindle 23. In the center of the spindle 19, which is attached to the gear motor 4, there is a mirror 20 and in the center of the freely rotating spindle 23 there is a photo cell 24. The spindle arms 9 have been fastened to the end plates 13 through rails 14 in such way that the arms 9 move regarding the wrapper roll 2.

Collecting a new wrapper roll 2 happens with the device described above as follows. When the wrapper roll 3 used at the wrapping station is finished or when there is too little wrapper left on the roll for a complete wrapping, the old roll or the roll core has to be removed. After this, a new roll is collected. When the old wrapper roll 3 has been removed, the swinging spindle arms 9 are driven to the open-position on the rails 14 and the wrapper carriage is moved to the pick-up station 26 of the new roll 2.

The detectors placed in the carriage indicate the exact place of the roll 2 and that there are no extra rolls in the pick-up area. Next, the spindle arms 9 are turned towards the wrapper roll 2 that is to be collected. The wrapper roll 2 has to be positioned in such way that its center hole is on the path of the swinging spindle arms 9. The center hole has to be so precisely on the path of the spindles 19, 23 that their conical sections can be pushed into center hole. The spindles have the photo cell-mirror pair 20, 24, which gives a signal when the spindles 19, 23 arrive at the center hole. Therefore, using this method, the center hole of the roll has to be free and non-plugged so it can be detected. If the center hole cannot be found, an error message will be given. The spindle arms 9 are now driven on the rails 14 towards the roll 2 and the absolute sensor indicating their movement measures the distance of the spindle arms 9 from the end of the roll 2. When the reading of the absolute sensor indicates that the conical sections of the spindle arms are at least partially in the center hole, the brake holding the swinging spindle arms 9 in place in the swinging direction and the brakes affecting the sideways position of the spindle arms are released, whereupon the spindle arms 9 and the spindles 19, 23 position themselves freely with respect to the center hole. When the distance detector indicates that the spindle arms are attached to the ends of the roll, the roll can be lifted up to its use station.

If a change of the width or of the quality of the wrapper is desired, the wrapper roll in use has to be lowered away from the use station and a new roll has to be collected to replace it. The changing is done in such way that at first, the wrapper part that is on the feeding table 10 is rolled back around the roll. Then the wrapper carriage is driven to the changing position 27 that has been defined beforehand and the sensors are used to check whether the area is free. If the changing area is free, the partly used roll is lowered to the changing position. The swinging arms can now be moved to the open-position by moving them away from the roll. Then the spindle arms are lifted and the wrapper carriage is guided to the pick-up station of the new roll. Collecting the new roll happens as described above.

Figure 3A:
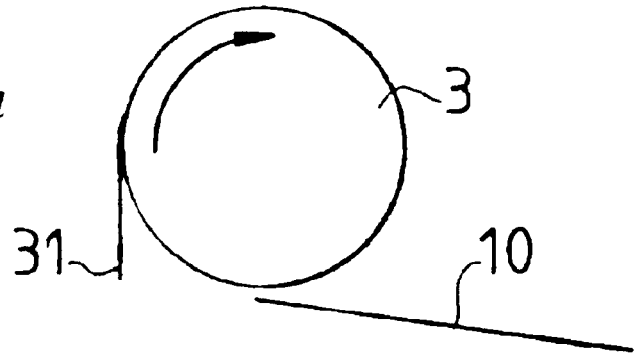
FIGS. 3*a*–3*c* are schematic illustrations of threading of the wrapper end in accordance with the invention.
Figure 3B:
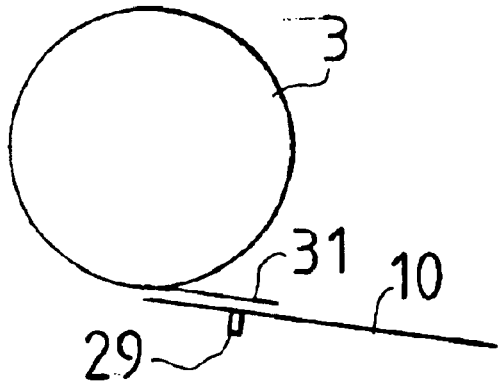
Figure 3C:
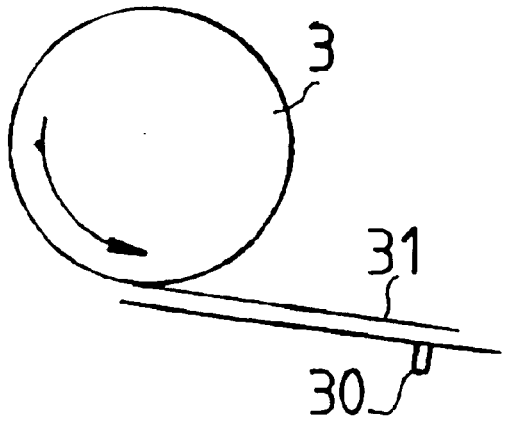

According to the present invention, the wrapper end 31 is threaded to the nip between the drawing rolls 11, 15 in the way that is shown in FIGS. 3*a*–3*c*. The roll 3, which has been collected to the use station as described above, has been prepared, i.e. its pacsupport has been removed and the wrapper end 31 has been released and cut in the specified shape. When the wrapper roll 3 has been lifted to the use station, the end 31 hangs down from the roll 3 as shown in FIG. 3*a* on the opposite side of the wrapper roll 3 with respect to the wrapper feeding table 10. Now, the roll 3 is rotated according to the arrows in FIG. 3*a* against the wrapper feeding direction, whereupon the wrapper end 31 goes around the roll 3 and falls on the wrapper feeding desk 10 as shown in FIG. 3*b*. At the same time as the roll is being rotated air is blown from the air nozzles 28 along the surface of the feeding table 10 and the stream of air moving on the surface of the table sucks the wrapper end 31 against the table. Thus the wrapper end 31 is detected by the sensor 29 and the wrapper roll 3 is stopped and its direction of rotation is changed to the direction of rotation of the wrapper in accordance with the arrow in FIG. 3*c*. Now the rotating motion of the roll 3 feeds the wrapper along the feeding table 10 and the air blown from the air nozzles 28 feeds the wrapper forward and keeps the wrapper on the surface of the table 10 and straight. When the wrapper end passes the drawing rolls 11, 15, it is detected by the sensor 30 and the nip between the drawing rolls 11, 15, which has been open, can be closed. The wrapper has now been threaded in its place and the wrapping station is ready for operation.

It is understood that the present invention is also suitable for other types of wrapping stations besides the one described above. The method is suitable e.g. for the kind of wrapping stations that have several stations for wrapper rolls. The types and positions of the sensors and air nozzles in the wrapper feeding table can vary according to the structure of the wrapping station that is used. Air does not have to be blown continually during the reverse rotating motion of the wrapper roll, but if the blowing is started before the wrapper end comes to the wrapper feeding table, it is more certain that It will be detected. It is also conceivable that with some wrapper qualities the air blowing is not used at all, but in that case the wrapper has to be slack enough to fall straight on the wrapper feeding table and yet stiff longitudinally so it can be fed by the rotating motion of the roll.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for threading a wrapper end from a wrapper roll to a nip between wrapper proportioning drawing rolls in a wrapping station for wrapping paper rolls, board rolls and pulp rolls, comprising:

rotating a wrapper roll in a use position against a wrapper feeding direction such that a wrapper end falls on a surface of a wrapper feeding table;

detecting when the wrapper end has fallen on the surface of the wrapper feeding table;

stopping rotation of the wrapper roll when falling of the wrapper end on the surface of the wrapper feeding table has been detected;

rotating the wrapper roll in the wrapper feeding direction until the wrapper end passes an indicator positioned after the wrapper proportioning drawing rolls; and blowing air along the surface of the wrapper feeding table so that the air is blown between the wrapper end and the surface of the wrapper feeding table so as to guide the wrapper end along the surface of the wrapper feeding table.

2. The method of claim 1, wherein air is blown along the surface of the wrapper feeding table before falling of the wrapper end on the surface of the wrapper feeding table has been detected.

3. An apparatus for threading a wrapper end from a wrapper roll in a wrapping station for wrapping paper rolls, board rolls and pulp rolls, comprising:

a wrapper feeding table;

a means for rotating the wrapper roll in a wrapper feeding direction and in a direction opposite to the wrapper feeding direction;

at least one first sensor positioned to detect when the wrapper end has fallen on a surface of said wrapper feeding table;

a means for feeding the wrapper end from said wrapper feeding table toward a roll to be wrapped;

a frame having a use position in which the wrapper roll may be placed so that wrapper from the wrapper roll can be fed from the use position to said means for feeding the wrapper end;

at least one air nozzle positioned to blow air along the surface of said wrapper feeding table so that the air is blown between the wrapper end and the surface of the wrapper feeding table so as to guide the wrapper end along the surface of said wrapper feeding table toward said means for feeding the wrapper end; and at least one second sensor positioned to detect when the wrapper end has passed said wrapper feeding means.

4. The apparatus of claim 3, wherein said at least one air nozzle is positioned in said wrapper feeding table.

5. The apparatus of claim 3, wherein said at least one air nozzle comprises a plurality of air nozzles.

* * * * *